United States Patent [19]

Osrow et al.

[11] 4,206,340

[45] Jun. 3, 1980

[54] ELECTROLYTICALLY HEATED FABRIC STEAMING DEVICE HAVING SELECTIVELY VARIABLE STEAM GENERATION AND DISTRIBUTION

[75] Inventors: Leonard Osrow, Great Neck; Jacques L. LeBaigue, Greenlawn, both of N.Y.

[73] Assignee: Osrow Products Co., Inc., Old Bethpage, N.Y.

[21] Appl. No.: 915,763

[22] Filed: Jun. 15, 1978

Related U.S. Application Data

[63] Continuation of Ser. No. 676,719, Apr. 14, 1976, abandoned.

[51] Int. Cl.[2] ..... H05B 1/02; H05B 3/60; D06F 75/10

[52] U.S. Cl. ..... 219/272; 38/69; 38/77.7; 38/77.82; 38/77.9; 68/222; 219/245; 219/275; 219/285; 219/290; 219/295

[58] Field of Search ..... 219/271-276, 219/284-295, 245, 254; 239/136; 68/222; 38/69, 74, 75, 77.1-77.9, 78, 82, 84, 85, 88, 89, 93; 221/51, 70, 73

[56] References Cited

U.S. PATENT DOCUMENTS

| | | | |
|---|---|---|---|
| 1,830,875 | 11/1931 | Izumiya | 38/77.2 X |
| 1,944,348 | 1/1934 | Kelley | 219/295 X |
| 2,188,011 | 1/1940 | Miller | 38/77.81 |
| 2,433,566 | 12/1947 | Hume | 38/77.82 |
| 2,664,653 | 1/1954 | Voskresenski | 38/77.4 X |
| 2,861,365 | 11/1958 | Block | 219/284 X |
| 2,885,527 | 5/1959 | Tone et al. | 219/289 X |
| 3,020,385 | 2/1962 | Conlin et al. | 219/295 X |
| 3,308,267 | 3/1967 | Fenstermaker | 219/290 |
| 3,755,649 | 8/1973 | Osrow | 219/245 |
| 3,969,607 | 7/1976 | Osrow et al. | 219/272 |

FOREIGN PATENT DOCUMENTS

| | | | |
|---|---|---|---|
| 1068826 | 2/1954 | France | 219/284 |
| 1072774 | 3/1954 | France | 38/77.8 |
| 1083733 | 6/1954 | France | 38/77.8 |
| 1088809 | 9/1954 | France | 219/284 |
| 414388 | 7/1934 | United Kingdom | 219/284 |

*Primary Examiner*—A. Bartis

*Attorney, Agent, or Firm*—Kirschstein, Kirschstein, Ottinger & Cobrin

[57] ABSTRACT

A steaming device for pressing and ironing fabric includes a hollow body and a sole plate having a pointed prow. A pair of passages lead from an electrolytically heated steam generator within the body to the front portion of the sole plate. The first passage is permanently open and leads to a plurality of first openings in a linear pattern generally aligned with the longitudinal axis of the prow. The second passage leads to steam openings in the sole plate which latter openings extend transversely across the width of the sole plate rearwardly of first openings. The second passage is larger than the first and has more steam openings associated with it so that steam will flow through it more readily than through the first. A plug is associated with the top of the second passage. The plug can be moved from a position in which the passage is unblocked to a position in which the passage is blocked. The electrolytically heated steam generator includes three electrodes disposed in a quantity of electrolytic solution provided within a reservoir within the body. The spacing between a first and a second electrode is greater than the spacing between the second and third electrodes so that steam generation rate may be controlled by an appropriate adjustable electric switch, with steam generation being at a higher rate when an electrical potential is impressed between the second and third electrodes than when the electrical potential is impressed between the first and second electrodes.

5 Claims, 6 Drawing Figures

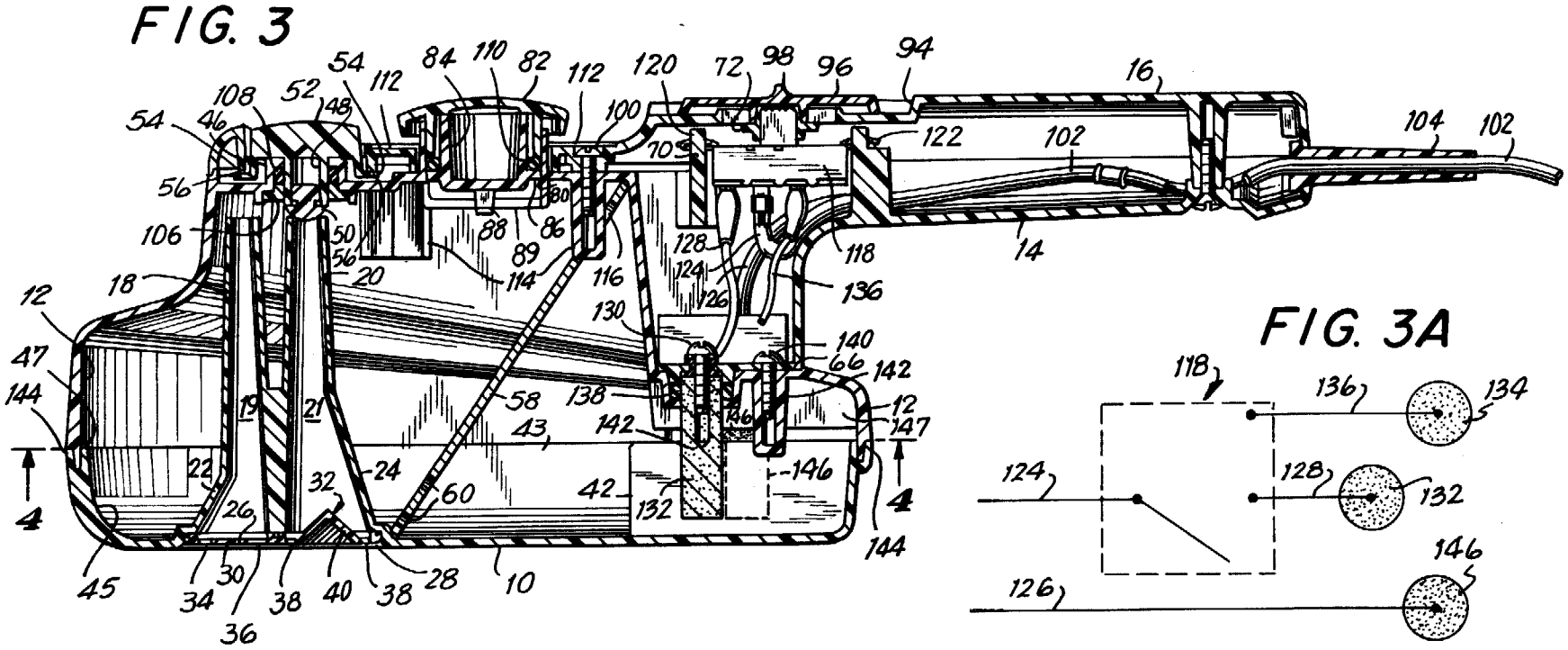
FIG. 3
FIG. 3A
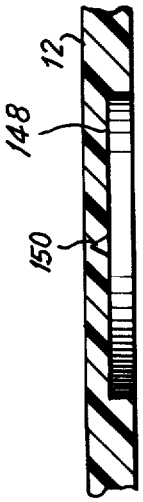
FIG. 5

ELECTROLYTICALLY HEATED FABRIC STEAMING DEVICE HAVING SELECTIVELY VARIABLE STEAM GENERATION AND DISTRIBUTION

CROSS-REFERENCE TO RELATED APPLICATION

This application is a continuation of application Ser. No. 676,719 filed Apr. 14, 1976 for STEAMING DEVICE WITH TWO OPENINGS, now abandoned.

BACKGROUND OF THE INVENTION

1. Field of the Invention

A hand-held steaming device wherein the quantity of steam generated can be selectively varied and wherein the device can be used to iron large areas of fabric or to open seams.

2. Description of the Prior Art

Portable hand-held steaming devices have been used for many years for performing pressing and/or steaming functions. Typical prior art hand-held steaming devices have been products which had included a plastic casing (usually formed by injection molding) within which was located a reservoir. Located within said reservoir were a pair of spaced apart parallel electrodes. In normal use, an electrolytic solution, e.g. water and salt, was placed in said reservoir and a current passed between said electrodes. Consequently, the electrolytic solution was converted to steam and directed through an outlet passage in the casing to the point of use.

Because of the light weight and easy manipulability of hand-held steaming devices, they are desirable to use for many purposes. As an example, it is desirable to use hand-held steaming devices for opening seams. More specifically, when two pieces of fabric are sewn together there usually is a small strip of material adjacent the seam in each piece of fabric. When the fabric is used as part of a garment, each strip of material is folded back against its respective piece of fabric.

In the past, irons have been used to open seams, but of course this was undesirable in that irons were heavy in weight besides being relatively expensive. Hand-held steamers have the inherent advantage over irons in being lighter in weight as well as being less expensive.

It is also desirable to be able to use a hand-held steaming device for ironing fabric such as has been conventionally done in the past by a steam iron.

It is, or course, obvious that if a hand-held steaming device could be designed that could be utilized for opening seams as well as for ironing fabric, it would have widespread use.

It is also desirable when using a hand-held steaming device to be able selectively to vary the quantity of steam generated by the device. As an example, for certain types of use a certain rate of steam generation may be desirable, whereas for other types of use a differing rate of steam generation (either higher or lower) might be required. It is thus desirable for a hand-held steaming device to be able to generate varying amounts of steam in accordance with the conditions of use and the requirements of such use.

SUMMARY OF THE INVENTION

1. Purposes of the Invention

It is an object of the present invention to provide an improved hand-held steaming device.

Another object of the present invention is to provide an improved hand-held steaming device which is capable of opening seams.

A further object of the present invention is to provide an improved hand-held steaming device which can be used for ironing fabric.

Yet another object of the present invention is to provide an improved hand-held steaming device that can be used for opening seams and for ironing fabric.

Another object of the present invention is to provide an improved hand-held steaming device wherein means is provided for enabling the amount of steam that is generated by said device to be selectively varied.

A further object of the present invention is to provide a hand-held steaming device which can be utilized to open seams and iron fabric and wherein the amount of steam that is generated by said device can be selectively varied to fit the requirements of use.

Still a further object of the present invention is to provide a hand-held steaming device having two outlet passages wherein each outlet passage is intended to be used for a particular function and wherein the quantity of steam discharged through at least one of said passages can be selectively varied.

Still another object of the present invention is to provide an improved hand-held steaming device wherein said device is designed so that if the pressure of the generated steam within the interior of said device is above a predetermined value, an opening will be formed through which the steam can be bled to prevent a dangerously high pressure level in the device.

Another object of the present invention is to provide an improved hand-held steaming device which is capable of achieving the above and other objects and which is reliable in operation.

Other objects of the invention in part will be obvious and in part will be pointed out hereinafter.

2. Brief Description of the Invention

According to the present invention, the foregoing as well as other objects which have not been specifically enumerated herein but which will be apparent to those skilled in the art are accomplished by a hand-held steaming device which includes a body. Attached to the bottom of the body is a sole plate and located in the interior of said body is a reservoir. Located within said reservoir and supported between said sole plate and a portion of said body, while being maintained on an incline with respect to the longitudinal axis of the hand-held steaming device, is a perforated baffle.

Extending upwardly from said sole plate are two passageways (the first and second passageways). The first passageway is closer to the tapering forward portion (prow) of the hand-held steaming device than the second passageway. The first passageway is in continuous communication with the reservoir. The first passageway is smaller in cross-section than the second passageway. Means is provided for controlling the communication between said second passageway and the reservoir interior. Said communication controlling means consists of a plug which is adapted to block the uppermost portion of the second passageway. Said plug is secured to and movable with a steam control knob which is received within a steam control knob receptacle on the hand-held steaming device cover. Within said steam control knob receptacle is a cammed surface. Said steam control knob includes a follower which cooperates with said cammed surface. Said steam control knob is rotated in said steam control knob receptacle to thereby place the plug either on the upper portion of said second passageway to block communication between said reservoir and said second passageway or, alternatively, said plug is spaced varying distances from the upper portion of said second passageway to modulate the flow of steam from said reservoir to said second passageway.

Said first passageway communicates with a transversely narrow set of openings in the sole plate near the prow. The second passageway communicates with a transversely wider set of openings in the sole plate. The first set of openings are used for seam spreading and the second set of openings are used for pressing.

Also located within said reservoir are three electrodes (first, second and third electrodes). Said first, second and third electrodes form a triangle with respect to one another, with said first and second electrodes being the base of the triangle and said third electrode being spaced an equidistant amount from said first and second electrodes. Baffles are located between the electrodes to lengthen the electrical paths between them.

Switch means is provided and connected to said switch means is a line cord. The switch means is designed so that when electrical potential is directed to said line cord, said electrical potential can be communicated to said first and second electrodes or, alternatively, to said second and third electrodes. Inasmuch as the distance between said first and second electrodes is greater than the distance between said second and third electrodes, a greater current will flow between said second and third electrodes when said switch means connects said electrical potential to said second and third electrodes than the electrical current that will flow between said first and second electrodes when said switch means connects said electrical potential to said first and second electrodes.

As a consequence thereof, more steam will be generated when electrical current is passing between said second and third electrodes than between said first and second electrodes. Thus, when it is desired to have a high rate of steam generated, the switch means will connect the electrical potential to said second and third electrodes and when it is desired to have a lesser amount of steam generated, said switch means will connect said electrical potential to said first and second electrodes.

If it is desired to use the hand-held steaming device for opening seams alone, the seam control knob is rotated until it is in a position wherein said plug blocks said second passageway. Alternatively, if it is desired to use the hand-held steaming device for ironing fabric, the steam control knob is rotated until the plug is spaced from the second passageway by a selected amount so that a desired amount of steam is passed through said second passageway. Because the second passageway is larger than the first, and because more steam openings are associated with the second passageway than with the first, when the plug does not block the second passageway steam will flow more easily through the second passageway than through the first whereby steam preferentially will flow through the second passageway and its associated steam openings. It should be apparent that by rotating the steam control knob the flow of steam through the second passageway can be modulated.

Irrespective of whether the steam is being directed through the first passageway or principally through the second passageway, the rate of steam generated in the reservoir can be controlled by the switch means connecting the first and second electrodes to the source of electrical potential (the low rate of steam generation) or by the switch means connecting the second and third electrodes to the source of electrical potential (the high rate of steam generation).

The invention accordingly consists in the features of construction, combination of elements and arrangement of parts which will be exemplified in the device hereinafter described and of which the scope of application will be indicated in the appended claims.

BRIEF DESCRIPTION OF THE DRAWINGS

In the figures, wherein like parts in the different figures are represented by identical reference numerals:

FIG. 3 is a longitudinal vertical sectional view of the device;

FIG. 3A is a circuit diagram;

FIG. 5 is a partially broken sectional view taken substantially along the line 5—5 of FIG. 4.

DETAILED DESCRIPTION OF THE PREFERRED EMBODIMENTS

Figure 1:
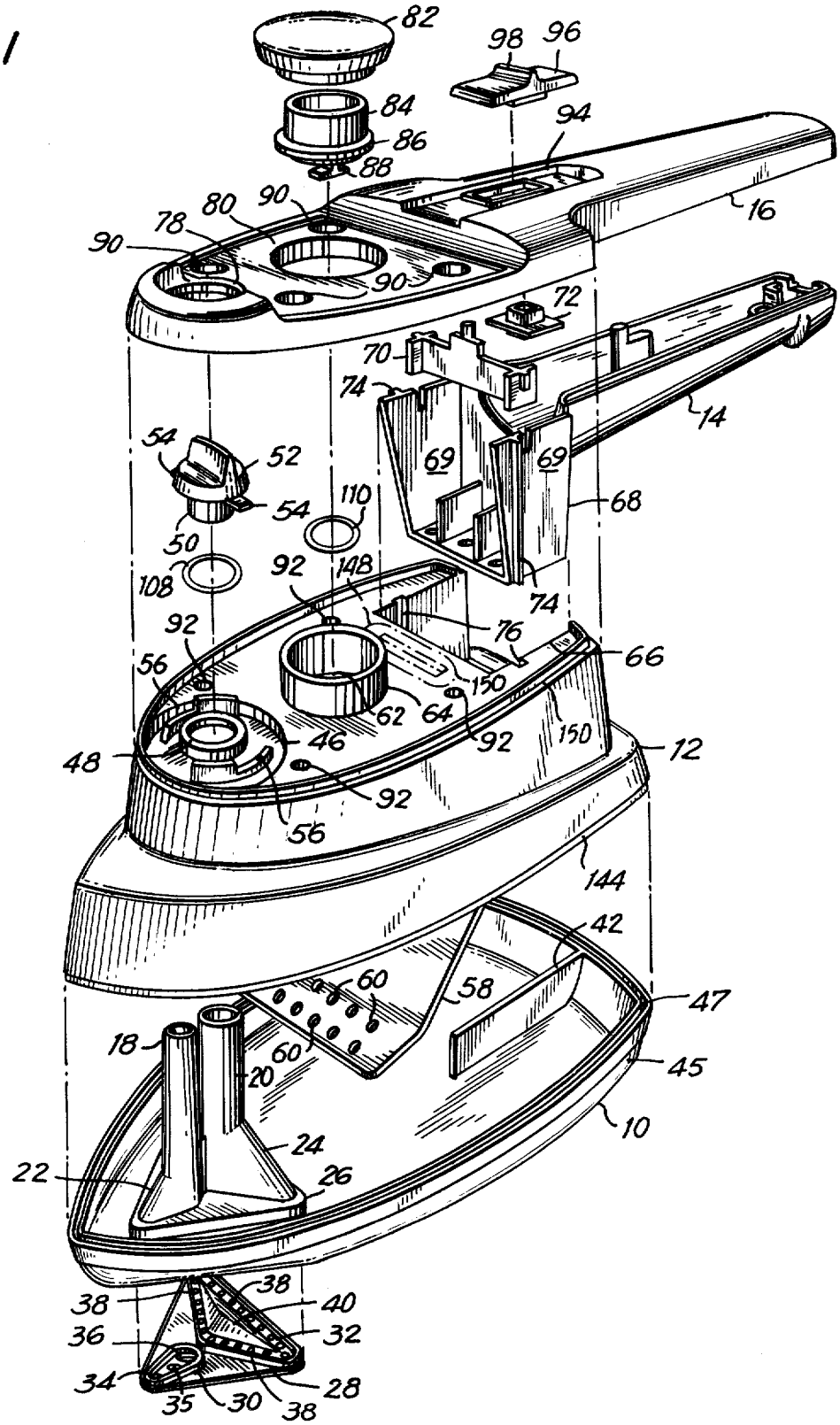
FIG. 1 is an exploded view of a hand-held steaming device according to the present invention.

Referring now to FIG. 1, the hand-held steaming device (iron) is generally characterized by the provision of a plastic sole plate 10, a plastic body 12 and a plastic handle 14. A cover plate 16 molded of plastic extends across the top of the body 12 and the handle 14.

The sole plate 10 is shown associated with internal conduits 18 and 20 which are generally vertically oriented and have internal passageways 19 and 21, respectively, for steam egress from the hand-held steaming device. Conduit 20 is oriented behind conduit 18 and passageway 21 is usually larger than passageway 19 in cross-section. A flared section 22 is provided for the lower end of conduit 18, and a flared section 24 is provided for the lower end of conduit 20. The sections 22 and 24 extend to a triangular mounting piece 26 which covers a steam outlet plate 28. Plate 28 is characterized in this preferred embodiment of the invention by the provision of a forward steam outlet piece 30 and a rearward steam outlet piece 32. Forward steam outlet piece 30 includes openings 34, 35 and 36 through which steam is discharged. These openings 34, 35 and 36 form a transversely narrow area immediately in back of the prow of the steam iron along the longitudinal axis of the plate 28 and are thus properly placed to aid in opening a seam.

Rearward steam outlet piece 32 includes a plurality of openings 38 about its periphery. The openings 38 form a transversely wide area centered with respect to the longitudinal axis of the plate 28 and through which steam will escape for ironing large pieces or surfaces of fabric when steam flow downwards through conduit 20 takes place. Steam flow downwards through conduit 18 is continuous. However, when steam selectively flows through conduit 20, flow of steam through the conduit 18 drops substantially because the conduit 20 is larger than the conduit 18, and further because more steam openings 38 are associated with the rearward conduit 20 than openings 34, 35 and 36 are associated with the forward conduit 18 so that steam flows more easily through the conduit 20 than through the conduit 18.

Rearward steam outlet piece 32 also is preferably provided with a pyramidal protrusion 40 which extends upwards into flared section 24 to facilitate the flow of steam in conduit 20 to openings 38.

A baffle 42 extends upwardly from sole plate 10 in reservoir 43 between certain electrodes as will hereinafter be described. A side wall 45 extends upwardly from sole plate 10 and includes a groove 47.

A measuring spoon (not shown) is used to measure out the requisite and proper amount of sodium chloride or other suitable salt to be added to water fed into the device, so that the resulting solution will conduct electric current to create heat and thereby allow the generation of steam for egress from the hand-held steaming device via conduit 18 and optionally via conduit 20.

Body 12 is characterized by the provision of a forward circular well 46 having a central opening 48 through which a rubber plug 50 that is mounted on control knob 52 extends downwards selectively to open or block the upper end of conduit 20, as is best shown in FIG. 3. Knob 52 is provided with opposed followers 54 which cooperate with the curved and sloped opposed cammed surfaces 56 on recess 46, so that manual rotation of knob 52 serves to move plug 50 upwards or downwards so as to open, partially block or fully block the upper end of conduit 20 and thereby regulate the flow of steam through said conduit.

A lower inclined foraminous baffle 58 depends from the central portion of body 12. A plurality of spaced openings 60 at the top and bottom of baffle 58 inhibit the deleterious effects of froth.

Body 12 is provided with a central circular opening 62 defined by an annular sleeve 64 which extends upwards from body 12 to cooperate with an opening 80 in cover plate 16, so that periodic additions of water and/or salt to reservoir 43 may be made to yield a body of electrolytic solution. It will, of course, be understood that, alternatively, salt may be dissolved in water external to the device, in which case electrolytic solution, per se, would be fed downwards through opening 62.

Body 12 is also provided with a rearward recess 66 which accommodates the mounting of the forward portion of handle 14 in the hand-held steaming device.

Handle 14 is provided with a forward section 68 having opposed sides 69 which depend downwardly to fit into recess 66, and appurtenances 70 and 72 for the mounting of an electrical switch. Opposed vertical flanges 74 of forward section 68 are on the outside surfaces of sides 69 and fit into grooves 76 provided in recess 66, so that handle 14 is firmly emplaced and good control of movement of the hand-held steaming device can be obtained by gripping handle 14.

Cover plate 16 is provided with a forward recess 78 to accommodate control knob 52. An opening 80 in cover plate 16 cooperates with sleeve 64 and a filler cap 82 is disposed over said opening in service. The filler cap 82, best shown in FIG. 3, includes an integral sleeve member 84 having an annular lower lip 86 upon which rests an O-ring 110. A lock member 88 cooperates with a slit opening S (see FIG. 4) which is formed in the bottom horizontal surface 89 of sleeve 64.

A plurality of openings 90 in cover plate 16 accommodate screws 100 which are inserted during assembly of the hand-held steaming device and screwed into openings 92 in body member 12. Cover plate 16 is also provided with a rearward switch recess 94, over which movable switch member 96 is positioned for manual forward or rearward movement to different positions, depending on the amount of steam generation desired, as will appear, infra. A central linear transverse ridge 98 is provided on the top surface of switch member 96 to facilitate manual manipulation of member 96.

Figure 2:
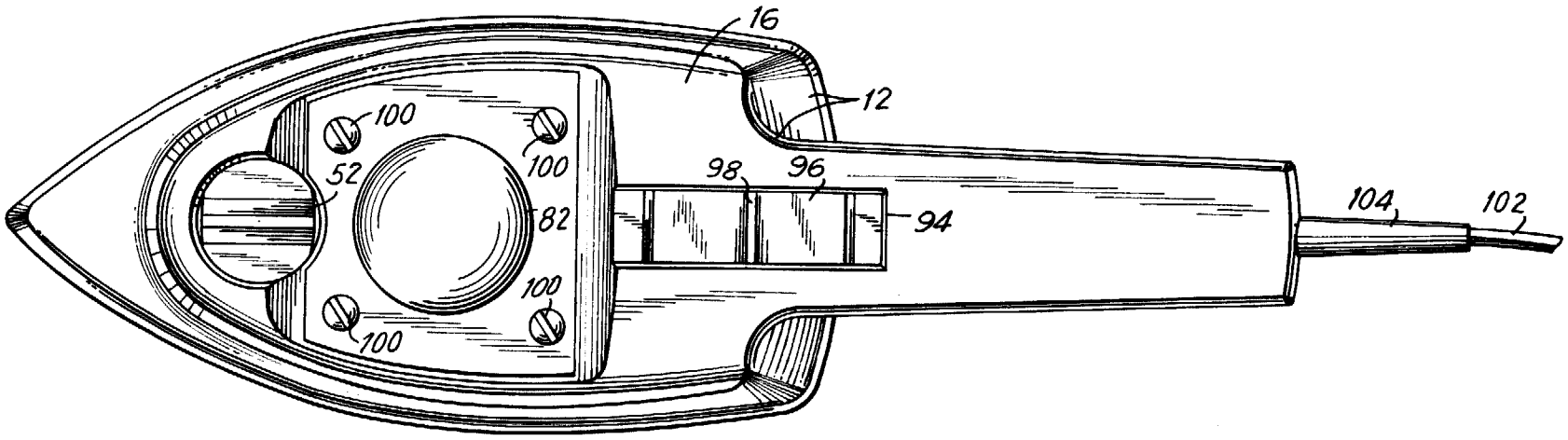
FIG. 2 is a top view of a hand-held steaming device according to the present invention.

FIG. 2 shows the assembled hand-held steaming device.

Electric current is furnished by electric cord or cable 102 which enters via a flexible annular cord protector 104 provided in order to preclude sharp bending of the cord 102 in service which would lead to premature wear and/or breakage.

FIG. 3 illustrates exemplary details of the internals of the device. The control knob 52 has been rotated to a position in which plug 50 is lowered to a bottom position, at which it completely covers and blocks the upper steam inlet to conduit 20, so that steam only flows through conduit 18. The appurtenances of knob 52 are shown; these include a sleeve 106 which retains an O-ring 108. The screws 100 are screwed into wells 114 in the top of body 12, the rear wells 114 extending downwards through large openings 116 at the rear of baffle 58.

Figure 4:
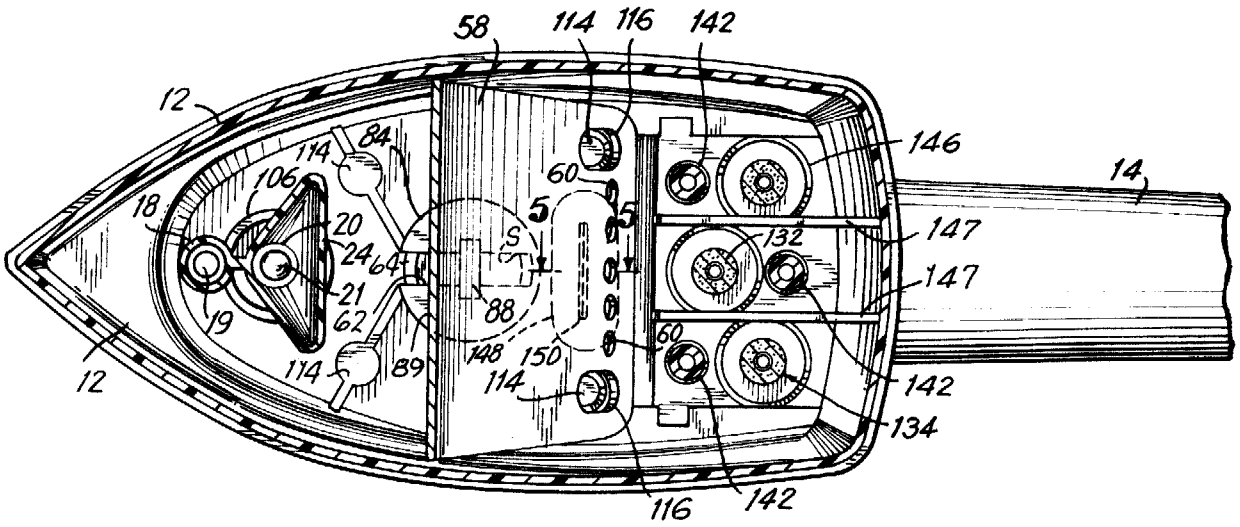
FIG. 4 is a sectional view taken substantially along the line 4—4 of FIG. 3.

Electric cord 102 extends to switch 118 which extends between switch bridge 120 and Tinnerman nut 122. The details of the switch internals, appurtenances and operation will be well understood by those skilled in the art. Thus, the electric cord 102 is separated into branch wires 124 and 126. Wire 124 is connected to switch 118 while wire 126 is directly connected to one of the three electrodes (146) which are best seen in FIG. 4. Wire 128 extends from switch 118 to screw fitting 130 associated with front electrode 132 generally composed of carbon or the like, wire 126 extends to a screw fitting associated with rear electrode 146, and wire 136 extends to a screw fitting associated with rear electrode 134 (shown in FIG. 4). O-rings such as 138 are provided for sealing purposes for each electrode.

Screws such as 140 extend into threaded wells such as 142 in body 12 to hold the handle 14 in place on the body member 12 thereby providing a unitary assemblage.

Sole plate 10 is attached to body member 12 by tongue 144 received in groove 47 which is a linear joint extending about the periphery of the members 10 and 12.

FIG. 4 shows the preferred triangular configuration of the three electrodes, namely, rear electrodes 134 and 146 described previously, and front electrode 32. One side of the electrical potential is conducted by wire or cord 126 to electrode 146. Hence, this electrode 146 cooperates either with the closer electrode 132 to impress a greater amount of electric current on the electrolytic solution and consequently to evolve a greater amount of steam; or else electrode 146 cooperates with further spaced electrode 134 to impress a lesser amount of electric current on the electrolytic solution, due to the wider gap and, hence, greater resistance to current flow between electrodes 134 and 146. The electric switch will, of course, also be provided with an off position in practice, in which setting electric current flow completely ceases. The electric control circuit aforesaid is illustrated in FIG. 3A.

Baffles 147, integral with body 12, are located between electrodes 146 and 132 and between electrodes 132 and 134 in the assembled hand-held steaming device (FIG. 4) and are parallel to and one of them is in registry with baffle 42. Baffles 42 and 147 provide a maximum current path between the electrodes.

FIG. 4 also shows, in phantom outline, a means for the safe relieving of excessive steam pressure, consisting of a horizontal thin plate 148 disposed on the top of body member 12. Plate 148 is provided with a linear weakened zone 150 which selectively yields and ruptures to relieve high steam pressure due to malfunctions after excessive service, thus preventing explosion or blowout of O-rings.

FIG. 5 shows details of the plate 148 and weakened zone 150. The plate 148 is preferably part of the top surface of body member 12; however, plate 148 may alternatively be provided on a side surface of body member 12.

The flared sections 22, 24 come into play if the steam iron is inverted (sole plate uppermost) while steam is being generated. If it were not for these flared sections, inversion of the steam iron would cause accumulated steam trapped in the steam chamber to jet boiling hot water through the openings 34, 35, 36 and 38 with consequent danger to the operator and to the room in which the steam ironing is being performed. However, the flared sections and consequent increase in cross-section of the conduits 18, 20 dissipate the force of ejection.

It thus will be seen that there is provided a hand-held steaming device which achieves the various objects of the invention and which is well adapted to meet the conditions of practical use.

As various possible embodiments might be made of the above invention, and as various changes might be made in the embodiment above set forth, it is to be understood that all matter herein described or shown in the accompanying drawings is to be interpreted as illustrative and not in a limiting sense. Thus it will be appreciated that the drawings are exemplary of a preferred embodiment of the invention.

Having thus described the invention there is claimed as new and desired to be secured by Letters Patent:

1. A hand-held steaming device comprising a hollow body, a handle extending from said body, an elongated sole plate having a pointed prow, said sole plate including a first steam discharge means immediately in back of the prow and constituting a plurality of openings aligned in a linear longitudinally extending pattern, which openings form a narrow area generally aligned with the longitudinal axis of said prow, and a second steam discharge means disposed rearwardly of said first discharge means and extending transversely across said sole plate, means within said body to generate steam, and two passages extending within said body and communicating respectively with said a first and a second steam discharge means in said sole plate, both of said passages being in communication with said means to generate steam, said first passage being permanently open, said second passage being provided with manually operable control means for modulating the flow of steam therethrough to said second steam discharge means between a first condition wherein the second passage is open and a second condition wherein the second passage is blocked, whereby when the second passage is blocked steam will exit solely through said first steam discharge means.

2. The hand-held steaming device of claim 1 in which the means within the body to generate steam includes at least three spaced electrodes in said body, switch means selectively operable to impress an electrical potential between a first one and a second one of said electrodes and between a first one and a third one of said electrodes, the distance between the first one and the second one of said electrodes being different than the distance between the first one and the third one of said electrodes, a steam generating chamber within said body for receiving a quantity of aqueous electrolyte, said electrodes being supported so as to be immersed in said electrolyte, and electrically non-conductive barrier means disposed in said chamber and supported by said body for lengthening the electrical path between the first and second electrodes and between the first and third electrodes through said electrolyte.

3. The hand-held steaming device of claim 1 in which the steam generating means includes a steam generating chamber adapted to receive an aqueous electrolyte, means in said chamber for electrolytically heating the electrolyte, and a foraminous baffle within the steam generating chamber and interposed between the electrolytic heating means and said first and second passages to minimize the presence of froth at the passages.

4. The hand-held steaming device of claim 1 in which the means to block the flow of steam to said second passage comprises a plug within said body, said plug being disposed at the steam inlet to said second passage, a knob mounted in a receptacle on the outer surface of said body, said plug being mounted in the inner end of said knob, said receptacle being provided with a camming surface, said knob including a follower which cooperates with said camming surface whereby rotation of said knob in said receptacle positions said plug at varying distances from the inlet to said second passage, whereby the flow of steam from the means to generate steam to said second passage may be opened or blocked.

5. The hand-held steaming device of claim 1 in which the lower ends of the first and second passages flare to increase the cross-sections thereof.

* * * * *